US006386997B1

(12) United States Patent
Brown

(10) Patent No.: US 6,386,997 B1
(45) Date of Patent: May 14, 2002

(54) ULTIMATE RING TOSS GAME

(76) Inventor: Kenneth M. Brown, 468 Puebla, Encinitas, CA (US) 92024

( * ) Notice: Subject to any disclaimer, the term of this patent is extended or adjusted under 35 U.S.C. 154(b) by 0 days.

(21) Appl. No.: 09/566,924

(22) Filed: May 6, 2000

(51) Int. Cl.[7] ..... A63B 67/06
(52) U.S. Cl. ..... 473/490; 473/415; 273/317
(58) Field of Search ..... 473/490, 588, 473/589, 415; 273/317, 317.1

(56) References Cited

U.S. PATENT DOCUMENTS

| | | | | | |
|---|---|---|---|---|---|
| 2,634,982 | A | * | 4/1953 | Gaede | 473/588 |
| 3,554,551 | A | | 1/1971 | Apiki | |
| 3,865,371 | A | | 2/1975 | Theriot | |
| 3,923,304 | A | | 12/1975 | Warren | |
| 4,284,277 | A | | 8/1981 | Leonard et al. | |
| 4,456,265 | A | * | 6/1984 | Adler | 473/588 |
| 4,911,443 | A | | 3/1990 | Foster | |
| 5,016,891 | A | | 5/1991 | Nelson | |
| 5,207,433 | A | | 5/1993 | Moore | |
| 5,362,067 | A | * | 11/1994 | Nelson | 273/317 X |
| 5,531,624 | A | * | 7/1996 | Dunipace | 473/588 X |
| 5,599,025 | A | | 2/1997 | Pobee-Mensah | |
| 5,741,194 | A | * | 4/1998 | Simunek | 473/490 |
| 6,010,416 | A | * | 1/2000 | Frederick | 473/490 |

FOREIGN PATENT DOCUMENTS

| | | | | |
|---|---|---|---|---|
| GB | 191155 | * | 1/1923 | 473/FOR 225 |
| WO | 93/17761 | * | 9/1993 | 473/FOR 225 |

OTHER PUBLICATIONS

"UPA Rules of Ultimate", ninth ed., copyright 1970 [online], [retrieved on Jun. 14, 2001]. Retrieved from the internet <URL:http://www.cs.rochester.edu:80/u/ferguson/ultimate/new–rules.html>.*

San Diego No. County Times, Feb. 23, 2000 "Middle–School Class Hams it up for Disney" pp. B1+B5.

* cited by examiner

*Primary Examiner*—Raleigh W. Chiu
(74) *Attorney, Agent, or Firm*—Henry M. Stanley

(57) ABSTRACT

A game for play between opposing teams on a field involves a resilient ring that is thrown by a team member to be caught by another member of the same team. The field is marked to display a rectangular playing area having a midfield location and scoring or URT areas extending across opposing ends of the playing area. Supplemental scoring or PAU areas are marked by fiat rings situated a predetermined distance beyond the ends of the playing area. Scoring occurs when a player on offense catches the resilient ring within the defense URT area. Supplemental scoring occurs when the player on the offense throws the ring from the defense URT area to come to rest in the defense PAU area.

11 Claims, 1 Drawing Sheet fig_1
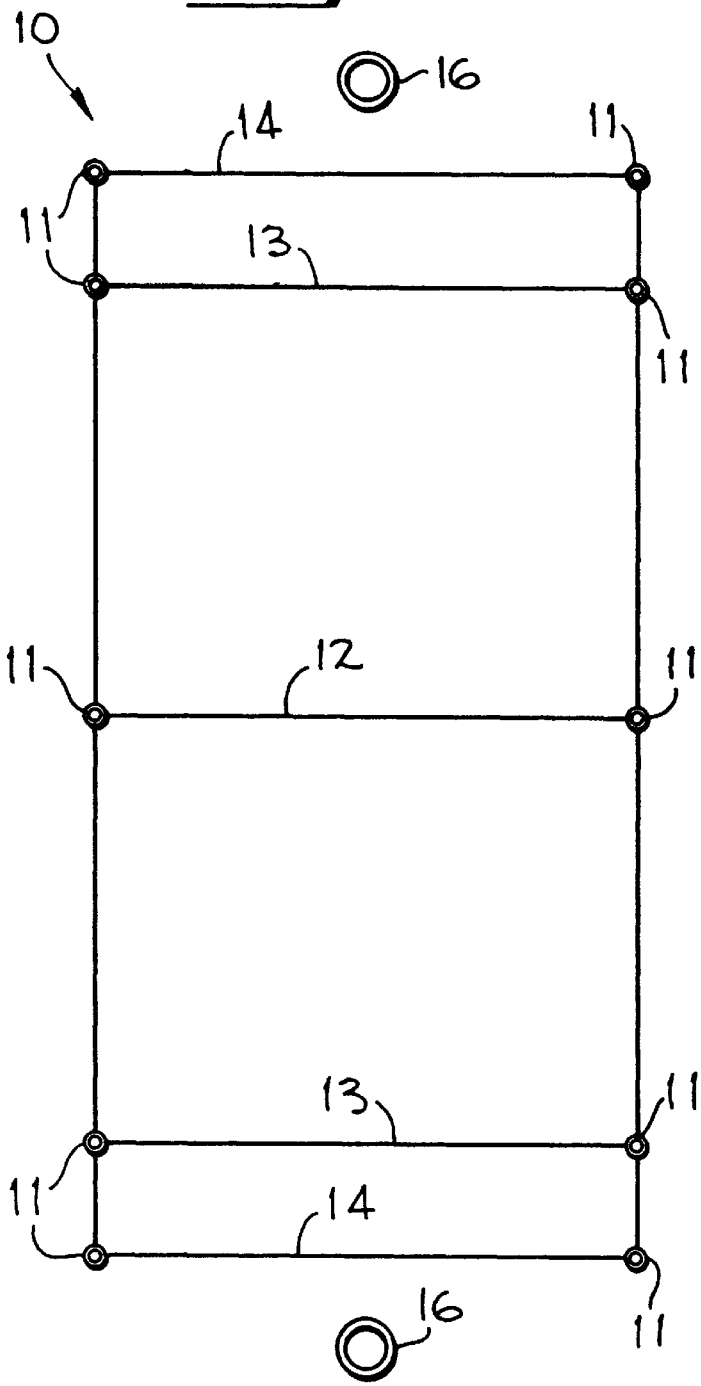
fig_2
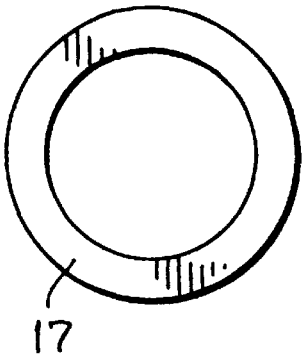
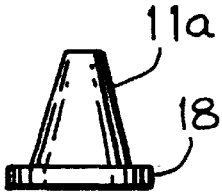
fig_3
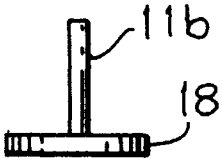
fig_4

ULTIMATE RING TOSS GAME

SUMMARY OF THE INVENTION

A method is disclosed for playing a game on a field between teams having equal numbers of players. The method includes the step of initially designating one team as offense and the other team as defense. Thereafter, the method includes providing a ring for manual engagement by the players, whereby the ring is thrown by and caught by the players in the course of the game. The field is marked to define a substantially rectangular playing area having a width and a length and defining a midline across the width of and substantially midway along the length of the field. Designating a pair of scoring areas across the width of and at opposing ends of the length of the field is followed by outlining a pair of supplemental scoring areas on the field surface that are spaced a predetermined distance from respective ones of the pair of scoring areas. Thereafter, the method includes requiring a throwing player of the offense team to throw the ring to a receiving player of the offense team while allowing guarding of offense players by defense players disposed at a predetermined distance from the offense players. The method of playing further includes limiting the steps a receiving player may take before throwing the ring to another receiving player of the offense team, the offense registering a URT score when the ring is caught by an offense player within the scoring area at the defense end of the field. In addition, the method includes calling a turnover when the thrown ring is blocked or intercepted by a defense player or dropped by a receiving offense player, whereupon team offense and defense designations are reversed. Ultimately, the method of play includes providing a supplemental PAU score attempt following a URT score, wherein an offense player is allowed to throw the ring unguarded from a position on the defense end of the field in an attempt to bring the ring to rest on the field within the defense team supplemental scoring area.

Apparatus is disclosed for playing a game between opposing teams having equal numbers of offense and defense players on a field including a plurality of markers for placing on the field for defining a field length, a field width and a pair of first areas of predetermined depth extending across each end of the field length. Further, means is provided for defining a pair of second areas on the surface of the field, wherein the second areas are located a predetermined distance beyond each end of the field length. A manually engageable ring is provided for throwing and catching by the players, whereby a score is registered by an offense player by catching the ring inside one of the first areas and a supplemental score is registered by the offense player after the score by throwing the ring to rest on the surface of the field within one of the second areas.

In a further definition of apparatus for playing a game between opposing teams having equal numbers of offensive and defensive players on a field, twelve markers are included for placement on the field for defining a rectangular playing area having a width and a length. The playing area has a scoring area across each end of the playing area length and a midfield position. A manually engageable resilient ring is provided for throwing and catching by offensive players and for blocking and interception by defensive players. A pair of circular rings are also provided for laying flat on the field in positions spaced beyond each scoring area, wherein the circular rings have diameters substantially four to five times the outside diameter of the manually engageable resilient ring.

BRIEF DESCRIPTION OF THE DRAWINGS

FIG. 1 is a plan view of a playing area on a field for playing the game of the present invention.

FIG. 2 is a plan view of a manually engageable ring for use in playing the game of the present invention.

FIG. 3 is an elevation of a marker for defining the playing area of the game of the present invention.

FIG. 4 is an elevation of an alternate marker for defining the playing area for the game of the present invention.

DESCRIPTION OF THE PREFERRED EMBODIMENTS

Earlier and less defined versions of the game to be described herein have been played for a number of years prior to the formalization and refinement of the game called "Ultimate Ring Toss" as described and claimed herein. Impetus was lent to refinement of the game and formalization of the rules by recent inquiries from an entity desiring to record playing of the game. FIG. 1 shows a layout 10 of a playing area on a level playing field. The size of the playing area varies depending on the number of players on each of two teams. The playing area is rectangular at its outer boundaries requiring a field approximately 55 yards long and 30 yards wide for teams containing four to six players each Games containing eight to ten players each need a larger area, in the realm of 80 yards long by 40 yards wide. The playing area as seen in FIG. 1 is marked by twelve markers or standards 11 that are set on the playing field to define the playing area of FIG. 1. The standards 11 define a midfield line 12 extending across the width of the playing area. A URT line 13 is shown extending across the width of the playing area spaced up field from each end of the playing area The letters URT represent an acronym for the name of the game, Ultimate Ring Toss. At opposing ends of the playing area, PAU lines 14 extend across the width of the playing area. The letters PAU represent an acronym for the words Point After URT. Spaced from and beyond each end of the playing area as seen in FIG. 1 is a PAU circle 16. The PAU circle may be a tubular plastic circle similar to that known as a hula hoop. Any configuration of light material circular in shape may be used to define the PAU circle as long as it lays flat upon the playing field. Instrumental to the game is the use of a rubber ring 17 as seen in FIG. 2 that is thrown and caught by the players in the course of the game. The ring is soft and somewhat pliable so that a player that is hit by the ring is unlikely to sustain any injury. This fact prompts the saying, "You can't get hurt in URT". Furthermore, players are likely to have a much higher success rate in throwing and catching the ring than players in other skill games, such as football, basketball, or Frisbee. The markers 11 are seen in FIG. 3 as cones 11*a*, made of a pliable or soft plastic material. In FIG. 4, an alternative form of the marker 11 is seen as 11*b* also made of a soft and pliable material. The markers or standards 11 are seen in FIGS. 3 and 4 to be supported by flat bases 18 to afford stability on the field while marking the playing area for the game disclosed herein.

In the game of URT, teams can be from three to ten players. The game sets up well for playing fields that afford limited space. The game of URT starts at the middle of the playing area 10, one team being designated the offense team and the other team being designated the defense team. The offense team lines up on the midline 12 of playing area and the defense team players must be five yards away toward the end of the field they are defending. The player on the offense team throws the ring to another player on the offense team to begin play. The offense team player may take only two steps after catching the ring 17. A defense player may guard the offense player in possession of the ring after the two steps are taken. The defense player must stay at least one arm length away from the offense player in possession of the ring and cannot grab or knock the ring from the offense player's hand. Upon receipt of the ring by the offense player, the defense player begins counting one URT, two URT, three URT, four URT, five URT. If the offense player has not thrown the ring by the five URT count, a turnover occurs and the previously defense team takes possession of the ring 17 at the point of turnover. Additionally, any pass from one offense player to another offense player that is not caught by a member of the offense team becomes a turnover and possession is transferred to the previously defense team. Any catch made simultaneously by a defense player and an offense player is retained by the offense team. Ring 17 must be tossed or thrown from one offense player to another offense player and may not be merely handed off. The defense player may intercept the ring or knock it down. If the ring is knocked down or intercepted, the previously offense player becomes a defense player and backs up one arm length and the previously defense player becomes an offense player and begins throwing the ring to team members with the object of producing a catch in the URT zone between the URT line 13 and the PAU line 14 being defended by the defense team A score is made when the offense team throws the ring to an offense team member and the ring 17 is caught while the catching player's feet are within the URT zone being defended. An offense player may not catch the ring 17 and take the allowable two steps into the URT zone to score. Any incomplete or blocked pass of the ring to an offense player within the URT zone is a turnover and the previously defense team takes possession and begins play again as the offense team five yards up field from the URT line at their end of the playing area 10.

When a defense player commits non-incidental body contact with an offense player in possession of the ring 17, the offense player shouts "You URTed me" and the defense must move five yards away from the offense player and play starts again. If the offense players either throw the ring 17 beyond the boundaries of the playing area 10 or it is caught by an offense player outside the boundaries, it is a turnover and the previously defense team takes possession and performs an URTin. Defense players must stay at least five yards away from an offense player during an URTin. In summary, the defense must remain at least five yards away from an offense player at the start of the game, after a foul, after an incomplete URT, and during URTins.

A catch by an offense player in the defense URT zone is called a URT and is worth a three point score. After the score, the player who caught the ring 17 for the URT score proceeds to the PAU line and tries for a PAU. A PAU is a "Point After URT", which means done or finished in Hawaiian. The player attempts to toss the ring 17 and have it land within the PAU circle 16, which is typically placed about five yards from the PAU line 14. The ring cannot be touching any part of the PAU circle 16. If the PAU attempt is accomplished it is worth a score of one point. Following a URT score and the PAU attempt, the game is restarted at the middle of the field with the non-scoring team now being the offense team.

As previously mentioned, the size of the field varies depending on the number of players on each team. Four to six players on each team work well on fields approximately 55 yards long and 30 yards wide. Eight players on each team need a larger area, approximately 80 yards long by 40 yards wide. In the instance where a field of 55 yards length and 30 yards width is used, the PAU circles 16 are spaced five yards away from the PAU line 14. A five yard spacing is used between each of the PAU lines 14 and the URT lines 13. In this example, there are 45 yards between the URT lines 13, and the midfield line 12 is always situated at the middle of the field length, no matter what the dimensions of the playing area 10 may be. The field area between the PAU lines 14 and the URT lines 13 are known as the URT zones. As previously mentioned, a catch by an offense player within the URT zone being defended by the opposing team is a URT score worth three points. The PAU circles 16 are approximately 32 inches in diameter. The manually engageable ring 17 is about 4½ inches on the inside diameter and about 1¼ inches thick. A typical ring 17 is therefore approximately 7 inches outside diameter. Thus, the equipment needed to play the game of URT includes the resilient ring 17, two PAU circles 16 and twelve standards or markers 11.

A glossary of terms used in the game of URT follows:

Motto: You can't get hurt in URT

Pass the ring to me: URT me

Calling a foul: You URTed me/I'm URTed

URT zone: Scoring area

URTin: Throw the ring in from the sideline following an out of bounds.

Scoring: URT score three points PAU score one point

PAU: Point after URT

Although the best mode contemplated for carrying out the present invention has been shown and described herein, it will be understood that modification and variation may be made without departing from what is regarded to be the subject matter of the invention.

What is claimed:

1. In a method of playing a game on a field between teams having equal numbers of players, wherein play includes initially designating one team as offense and the other team as defense, providing a ring for manual engagement by the players whereby the ring is thrown and caught by the players in the course of the game, marking the field to define a substantially rectangular playing area having a width and a length, defining a midline across the width of and substantially mid way along the length of the field, designating a pair of scoring areas across the width of and at opposing ends of the length of the field, requiring a throwing player of the offense team to throw the ring to a receiving player of the offense team, allowing guarding of an offense player by a defense player disposed at a predetermined distance from the offense player, limiting the steps the receiving player may take before throwing the ring to another receiving player of the offense team, the offense registering a URT score when the ring is caught by an offense player within the scoring area at the defense team end of the field, and calling a turnover when the thrown ring is blocked or intercepted by a defense player or dropped by a receiving offense player, wherein team offense and defense designations are reversed, the improvement comprising the steps of outlining a pair of supplemental scoring areas on the field surface spaced a predetermined distance from respective ones of said pair of scoring areas, and providing a supplemental PAU score attempt following a URT score wherein an offense player is allowed to throw the ring unguarded from a position on the defense end of the field attempting to bring the ring to rest within the defense team supplemental scoring area.

2. The method of playing the game of claim 1 comprising the step of creating a turnover when an offense player fails to throw the ring within a predetermined length of time after receiving the ring.

3. The method of playing the game of claim 1 comprising the step of giving an offense player an unguarded throw following non-incidental body contact by a defense player.

4. The method of playing the game of claim 1 comprising the step of turning over the offense to the defense when the offense fails to score on a throw within the scoring area at the defense team end of the field.

5. The method of playing the game of claim 1 comprising the step of placing three to eight players on each of the offense and defense teams.

6. The method of playing the game of claim 1 comprising the step of enlarging the length and the width of the field for a larger number of players on the offense and defense teams.

7. The method of playing the game of claim 1 comprising the steps of scoring three points for a URT score, and scoring one point for a PAU score.

8. Apparatus for playing a game between opposing teams having equal numbers of offense and defense players on a field, comprising a plurality of markers for placing on the field for defining a field length, a field width and a pair of first areas of predetermined depth, said first areas extending across each end of said field length, means for defining a pair of second areas on the surface of the field, said second areas located a predetermined distance beyond each end of said field length, and a manually engageable ring for throwing and catching by the players, whereby a score is registered by an offense player by catching said ring inside one of said first areas, and a supplemental score is registered by said offense player after said score by throwing said ring to rest on the surface of the field within one of said second areas, wherein said means for defining a pair of second areas comprises a pair of plastic rings.

9. Apparatus as in claim 8 wherein said means for defining a pair of second areas comprises a pair of rings, and wherein said manually engageable ring has a diameter substantially one quarter of the diameter of each of said pair of rings.

10. Apparatus for playing a game between opposing teams of equal numbers of offensive and defensive players on a field, comprising ten markers for placement on the field for defining a rectangular playing area having a width and a length, a scoring area across each end of the playing area length and a midfield position, a manually engageable resilient ring for throwing and catching by offensive players and blocking and interception by defensive players, and a pair of circular rings for laying flat on the field in positions spaced beyond each scoring area, said circular rings having diameters substantially four to five times in outside diameter of said manually engageable resilient ring.

11. Apparatus as in claim 10 wherein said pair of circular rings are substantially thirty-two inches in diameter and said manually engageable resilient ring is substantially seven inches in diameter.

* * * * *